United States Patent [19]

Nicolai

[11] Patent Number: 4,882,703

[45] Date of Patent: Nov. 21, 1989

[54] PROCEDURE FOR FINING ALL WORDS CONTAINED WITHIN ANY GIVEN WORD INCLUDING CREATION OF A DICTIONARY

[76] Inventor: Robert L. Nicolai, 4038 N. 9th St., St. Louis, Mo. 63147

[21] Appl. No.: 941,773

[22] Filed: Dec. 15, 1986

Related U.S. Application Data

[63] Continuation-in-part of Ser. No. 651,583, Sep. 17, 1984, abandoned.

[51] Int. Cl.[4] ..... G06F 7/24

[52] U.S. Cl. ..... 364/900

[58] Field of Search ..... 364/200, 900, 419

[56] References Cited

U.S. PATENT DOCUMENTS

| | | | |
|---|---|---|---|
| 4,270,182 | 5/1981 | Asija | 364/900 |
| 4,328,561 | 5/1982 | Convis | 364/900 |
| 4,339,806 | 7/1982 | Yoshida | 364/900 |
| 4,453,217 | 6/1984 | Boivie | 364/200 X |
| 4,597,057 | 6/1986 | Snow | 364/900 |
| 4,730,269 | 3/1988 | Kucera | 364/900 |

OTHER PUBLICATIONS

Hamilton, D. A. et al., "Method for Capitalization Checking During Spelling Verification", IBM Technical Disclosure Bulletin, May 1980, p. 5240.

Parrott, R. D., "Text Compression Using Spelling Dictionary", IBM Technical Disclosure Bulletin, Apr. 1983, p. 6249.

*Primary Examiner*—David L. Clark

[57] ABSTRACT

A procedure for finding words within words as implemented on a programmable digital computer first alphabetizes all letters in the given word then computes permutations of the alphabetized letters and compares them to a special dictionary created so that when a match is found in it this refers to dictionary words that are anagrams of the permutation of letters. The special dictionary is created by first preprocessing each word into an alphabetic concatenation of the letters in it, then appending the word to this anagram. This list is separated by word length, alphabetized and stored in random files for fast table look up. A finger index is created and used in the procedure to further speed execution of the process.

3 Claims, 7 Drawing Sheets

WORD 1 OF EACH RANDOM FILE:

WORD 2 OF EACH RANDOM FILE:

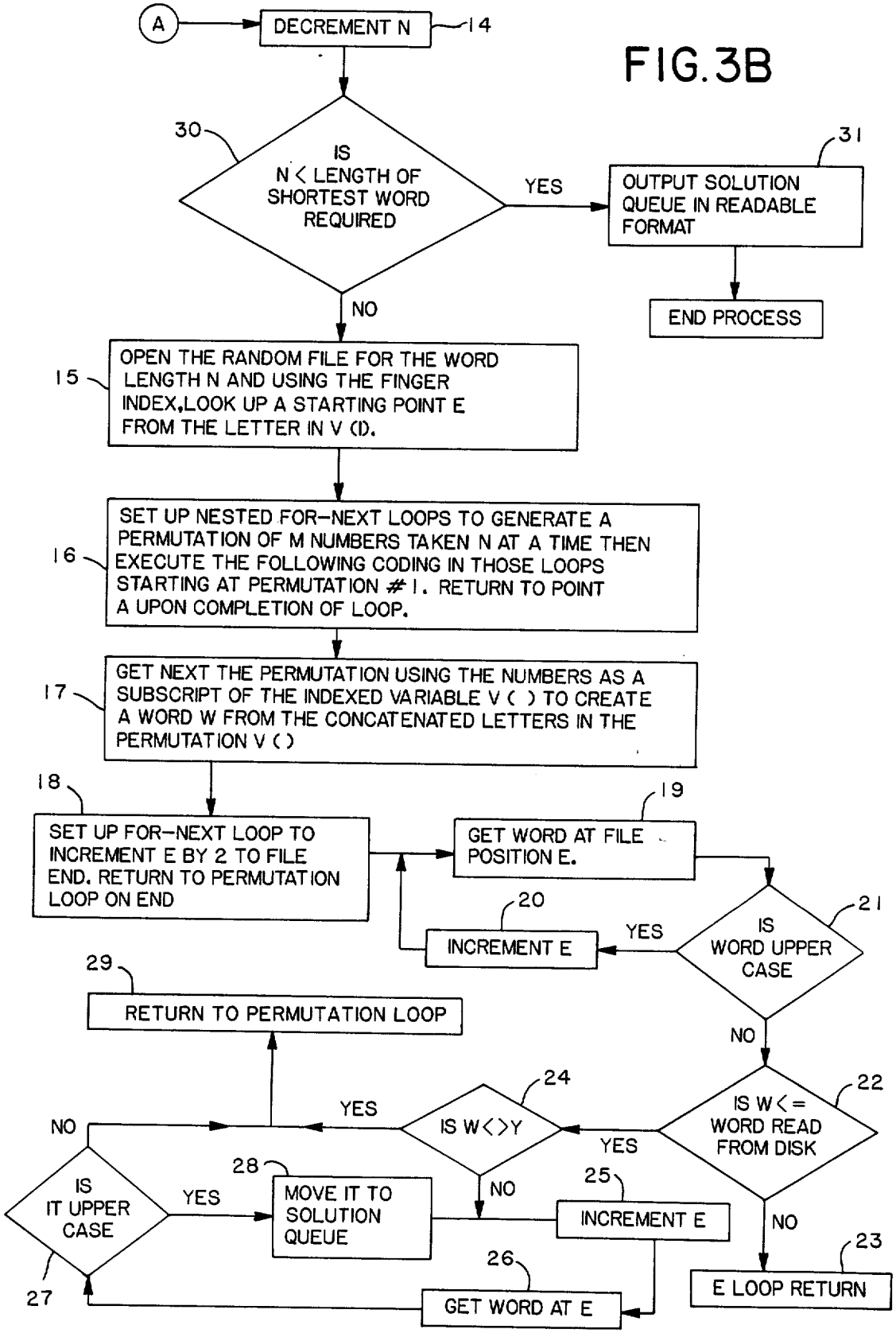
A
DECREMENT N
14
FIG. 3B
30
IS N < LENGTH OF SHORTEST WORD REQUIRED
YES
31
OUTPUT SOLUTION QUEUE IN READABLE FORMAT
END PROCESS
NO
15
OPEN THE RANDOM FILE FOR THE WORD LENGTH N AND USING THE FINGER INDEX, LOOK UP A STARTING POINT E FROM THE LETTER IN V (I).
16
SET UP NESTED FOR-NEXT LOOPS TO GENERATE A PERMUTATION OF M NUMBERS TAKEN N AT A TIME THEN EXECUTE THE FOLLOWING CODING IN THOSE LOOPS STARTING AT PERMUTATION #1. RETURN TO POINT A UPON COMPLETION OF LOOP.
17
GET NEXT THE PERMUTATION USING THE NUMBERS AS A SUBSCRIPT OF THE INDEXED VARIABLE V ( ) TO CREATE A WORD W FROM THE CONCATENATED LETTERS IN THE PERMUTATION V ( )
18
SET UP FOR-NEXT LOOP TO INCREMENT E BY 2 TO FILE END. RETURN TO PERMUTATION LOOP ON END
19
GET WORD AT FILE POSITION E.
20
INCREMENT E
YES
21
IS WORD UPPER CASE
29
RETURN TO PERMUTATION LOOP
NO
24
YES
IS W<>Y
22
IS W<= WORD READ FROM DISK
NO
YES
28
IS IT UPPER CASE
YES
MOVE IT TO SOLUTION QUEUE
NO
25
INCREMENT E
NO
23
E LOOP RETURN
26
27
GET WORD AT E

PROCEDURE FOR FINDING ALL WORDS CONTAINED WITHIN ANY GIVEN WORD INCLUDING CREATION OF A DICTIONARY

CROSS-REFERENCE TO RELATED APPLICATION

This application is a continuation-in-part of the US patent application Ser. No. 06/651,583 filed on 9/17/84, now abandoned.

BACKGROUND AND SUMMARY OF THE PROCESS

The game of finding words within words requires the player to know how all words in the language are spelled so that from any given work he may make up as many other words as possible using each letter only once.

The primary objective of this invention is to implement a process by which a microcomputer may obtain the same result in a minimal amount of time. The goal to be obtained by reaching that objective is to create a computerized game program which can be run on any microcomputer so that an individual playing the game can enjoy an interactive play environment. This process achieves that goal and, when properly implemented, offers a game that is significantly enhanced by the computer.

There are many procedures a computer can follow to find all words contained within any given word. One of the slowest is to go through a dictionary in alphabetical order and place each word listed in a queue then delete any letters from that queue which correspond to letters in the given word. If the queue is empty when all letters in the given word have been used then the word is one which can be found in the given word.

This method is unacceptable as one which could be implemented for a real time game program since it would take an hour for an BOBB based microprocessor used in many popular computers today to scan a word list of only 25,000 entries for just one word. The problem of implementing such a game is magnified by use of an 8 bit microprocessor such as the 65C02 used by some other computers where it could take many hours to scan the same list. Perhaps that is why no game has been marketed for any computer where the object is to find all words in any given word.

The method of finding words within words described herein preprocesses each individual word that the user may find in his solution so that for each word length anagrams of the word are directly associated with the preprocessed listing. Each listing is placed in alphabetical order in a special dictionary which contains a finger index to a starting point in it so that when searching for a match the program does not have to search the list from beginning to end.

In order to find all words contained in any given word the microprocessor is directed to arrange the letters in the given word in alphabetical order then to search each successive word length for permutations of letters in that word from the length of the word down to the lower limit of word length allowed by rules of the game. When a match is found to the permutation of letters all words associated with those letters are moved to a solution queue and may be arranged in alphabetical order before being sent to an output device.

The preprocessing of words into a concatenation of alphabetized letters which is then placed in alphabetical order may be stored on disk media or in computer memory. Although the process may be applied to data storage in a different media the procedure described herein constrains it to reside on a computer disk or a disk image resident in memory. This is not intended to be a limiting factor since, under a different procedure to effect the same process, only the method of storage and retrieval of data would change.

BRIEF DESCRIPTION OF THE DRAWINGS

FIGS. 3A and 3B: are a flow chart of the procedure used ot implement the process on a programmable digital computer.

DESCRIPTION OF THE PREFERRED EMBODIMENTS

Figure 1:
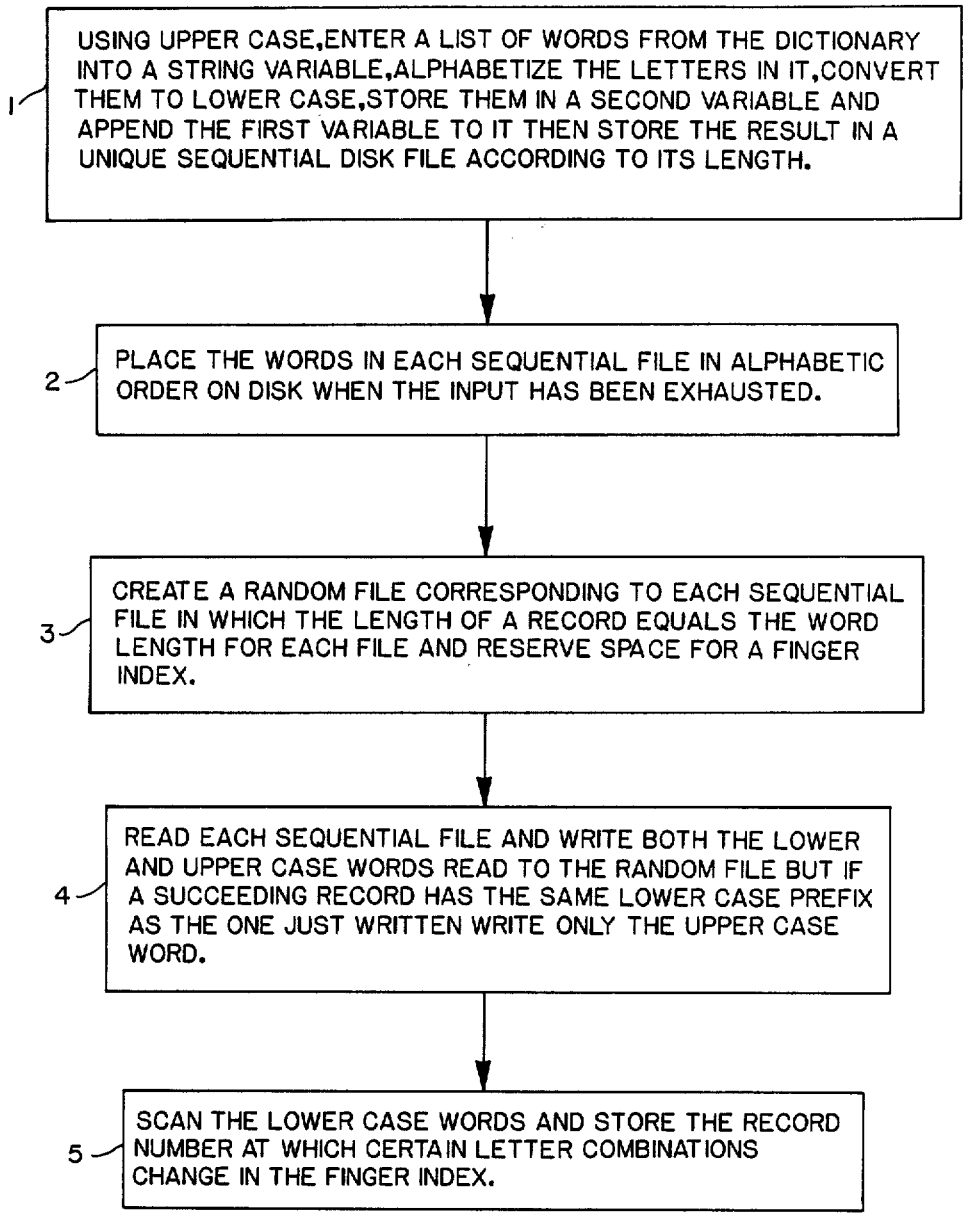
FIG. 1: is a flow diagram of the steps necessary to create the special dictionary used in conjunction with this process on a programmable digital computer.

The phases which will be used to define this process that may be unique to the BASIC language or have some special meaning in this application are:

RANDOM FILE: A disk file stored in numbered records of preset length. Each record is sequentially numbered so it may be accessed directly in any order by its number. File input will always be to a string variable named Y.

SEQUENTIAL FILE: A disk file stored in records of variable length. Each record is stored in sequential order and may be accessed only sequentially.

LOWER CASE: The alphabet of letters from "a" to "z" represented by the ASCII code from 97 to 122 respectively.

UPPER CASE: The alphabet of letters from "A" to "Z" represented by the ASCII code from 65 to 90 respectively.

ALPHABETIC ORDER: This generally consists of arranging words or letters from A to Z. For the description of this process that definition will be used but the this process is not limited such a use since any consistent method involving the prioritizing of words according to a preferred alphabetic sequence may be implemented to store words and search for matches using the process.

FINGER INDEX: This phase, when used herein, will refer to an index similar to that used in a standard dictionary where the starting point for the first letter of each word is shown by an indented cutout in the pages of the book. The finger index created by this process will, however, be a number pointer to the start of a particular concatenation of letters in a random file of words.

WORD COMPARISON: The BASIC language compares two words using a letter by letter comparison. The words are equal if the letters in each word have the same ASCII characters in the same order. Character positions are checked in sequential order from the first position to the last unless a mismatch is found. One word is less than another if the ASCII code for the first letter of the mismatch in the first word is less than the ASCII code for the same letter in the second word. The first word is said to be greater than the second if the match of letters at this point shows the first ASCII code to be greater than the second.

PREPROCESSING OF WORDS

The process for finding all words in any given word is based on the fact that words have been preprocessed and placed into a special dictionary for fast table look up. This dictionary is an integral part of the process because without it there could be no table look up. So before the process can be implemented we must first define what the dictionary must contain and how it should be created.

Any criterion may be applied to how words are chosen for insertion in the dictionary and any length of words may be used. In an effort to be illustrative rather than limiting, assume it has been determined that only words from four to six letters in length will be preprocessed into the dictionary to be used by this process. A sample list of words is shown in Table 1. This is only a small section of an entire list of words which may be chosen to be preprocessed.

TABLE 1

| |
|---|
| BAKE |
| BAKER |
| BAKERY |
| BALD |
| BALE |
| BALEEN |
| BALK |
| BALKY |
| BALL |
| BALLAD |
| BALLET |
| BALLOT |
| BALM |
| BALMY |
| BALSA |
| BALSAM |
| BAMBOO |
| BANAL |
| BAND |
| BANDIT |
| BANDY |
| BANE |
| BANG |
| BANGLE |
| BANISH |
| BANJO |
| BANK |
| BANKER |
| BANNER |
| BANTAM |

TABLE 2

| | | |
|---|---|---|
| ABEK | - | BAKE |
| ABEKR | - | BAKER |
| ABEKRY | - | BAKERY |
| ABDL | - | BALD |
| ABEL | - | BALE |
| ABEELN | - | BALEEN |
| ABKL | - | BALK |
| ABKLY | - | BALKY |
| ABLL | - | BALL |
| AABDLL | - | BALLAD |
| ABLLET | - | BALLET |
| ABLLOT | - | BALLOT |
| ABLM | - | BALM |
| ABLMY | - | BALMY |

TABLE 2-continued

| | | |
|---|---|---|
| AABLS | - | BALSA |
| AABLMS | - | BALSAM |
| ABBMOO | - | BAMBOO |
| AABLN | - | BANAL |
| ABDN | - | BAND |
| ABDINT | - | BANDIT |
| ABDNY | - | BANDY |
| ABEN | - | BANE |
| ABGN | - | BANG |
| ABEGLN | - | BANGLE |
| ABHINS | - | BANISH |
| ABJNO | - | BANJO |
| ABKN | - | BANK |
| ABEKNR | - | BANKER |
| ABENNR | - | BANNER |
| AABMNT | - | BANTAM |

TABLE 3

| | | |
|---|---|---|
| ABEK | - | BAKE |
| ABDL | - | BALD |
| ABEL | - | BALE |
| ABKL | - | BALK |
| ABLL | - | BALL |
| ABLM | - | BALM |
| ABDN | - | BAND |
| ABEN | - | BANE |
| ABGN | - | BANG |
| ABKN | - | BANK |
| — | | |
| ABEKR | - | BAKER |
| ABKLY | - | BALKY |
| ABLMY | - | BALMY |
| AABLS | - | BALSA |
| AABLN | - | BANAL |
| ABDNY | - | BANDY |
| ABJNO | - | BANJO |
| — | | |
| ABEKRY | - | BAKERY |
| ABEELN | - | BALEEN |
| AABDLL | - | BALLAD |
| ABLLET | - | BALLET |
| ABLLOT | - | BALLOT |
| AABLMS | - | BALSAM |
| ABBMOO | - | BAMBOO |
| ABDINT | - | BANDIT |
| ABEGLN | - | BANGLE |
| ABHINS | - | BANISH |
| ABEKNR | - | BANKER |
| ABENNR | - | BANNER |
| AABMNT | - | BANTAM |

Next the letters of each individual word in the list are alphabetized and associated with the dictionary listing of the word. Table 2 shows how this would look for the sample words shown in Table 1. Then each word length is separated so that all four letter words are in one list, five letter words in another list and six letter words in yet another list. This is shown for the sample words of Tables 1 and 2 in Table 3. Finally, the alphabetized letters shown for each different word length are alphabetized and any anagrams are collected under the same main listing in each word length. Table 4 shows how the words from the sample listing picked from a standard dictionary in Table 1 would combine with words not shown in Table 1, but assumed to be contained in the same list, to form the special dictionary of words for this example.

TABLE 4

| | | | | | | | | |
|---|---|---|---|---|---|---|---|---|
| ABDL | - | BALD | ABES | - | BASE | ABIT | - | BAIT |
| ABDN | - | BAND | ABET | - | ABET | ABJM | - | JAMB |
| | | | | | BATE | | | |
| ABDR | - | BARD | | | BEAT | ABKL | - | BALK |
| | | BRAD | | | | | | |
| | | DRAB | ABEU | - | BEAU | ABKN | - | BANK |

TABLE 4-continued

| | | |
|---|---|---|
| ABDU - DAUB | ABGN - BANG | ABKR - BARK |
| ABEK - BAKE | ABGR - BRAG | ABSK - BASK |
| BEAK | GRAB | ABLL - BALL |
| ABEL - ABLE | | |
| BALE | ABHS - BASH | ABLM - BALM |
| | | LAMB |
| ABEM - BEAM | ABHT - BAHT | |
| | BATH | ABLS - SLAB |
| ABEN - BANE | | |
| BEAN | ABIL - BAIL | ABLW - BAWL |
| ABER - BARE | ABIM - IAMB | ABNR - BARN |
| BEAR | | BRAN |
| BRAE | ABIS - BAIS | |

This exemplefies the process of creating a special dictionary to clarify the steps necessary to create it on a small computer. Referring to FIG. 1, in that procedure a list of words from a standard dictionary would be entered into a string variable on the computer for which the process will be implemented. For recognition purposes, the word will be input using all upper case letters. A second variable will be created from this one by converting the letters in it to lower case and alphabetizing them then the original variable will be appended to this one and this variable will be stored in one of several sequential disk files according to its length (1). Table 5 depicts how this file would look for the four letter words listed in Table 1. When it has been decided that all words which should be in the data base have been entered a routine will be called to place the records in each sequential file in alphabetic order (2).

TABLE 5

| | | |
|---|---|---|
| abdlBALD | abesBASE | abitBAIT |
| abdnBAND | abetABET | abjmJAMB |
| abdrBARD | abetBATE | abklBALK |
| abdrBRAD | abetBEAT | abknBANK |
| abdrDRAB | abeuBEAU | abkrBARK |
| abduDAUB | abngBANG | abskBASK |
| abdkBAKE | abgrBRAG | ablIBALL |
| abdkBEAK | abrgGARB | ablmBALM |
| abelABLE | abrgGARB | ablmLAMB |
| abelBALE | abshBASH | ablsSLAB |
| abemBEAM | abhtBAHT | ablwSLAB |
| abenBANE | abhtBATH | ablwBAWL |
| abenBEAN | abilBAIL | abnrBARN |
| aberBARE | abimiamb | abnrBRAN |
| aberBEAR | abisBIAS | |
| aberBRAE | | |

For each sequential file on disk a corresponding random file will be created wherein the length of a record is equal to the length of the dictionary word in each sequential file. The first two record positions of this file shall be reserved for placement of the finger index which is inserted after the file has been written (3). Each sequential file is then read and both the lower and upper case words are written in that order to the corresponding random file but if a succeeding record carries the same lower case prefix as the one just written then only the upper case word following it is written for this record and any similar succeeding records (4). Table 6 shows how stored data would look in the random file for the words shown in Table 5.

TABLE 6 abdlBALDabdnBANDabdrBARDBRADDRABabduDAUBabekBAKEBEAKabelABLEBALE
abemBEAMabenBANEBEANaberBAREBEARBRAEabesBASEabetABETBATEBEATabeu
BEAUabngBANGabgrBRAGGARBGRAbabhsBASHabhtBAHTBATHabilBAILabimIAMB
abisBIASabitBAITabjmJAMBabklBALKabknBANKabkrBARKabskBASKablIBALL
ablmBALMLAMBablsSLABablwBAWLabnrBARNBRAN

CREATING THE FINGER INDEX

Figure 2:
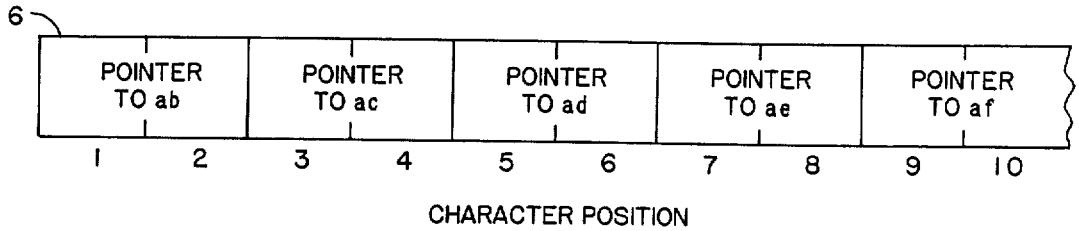
FIG. 2: depicts what information is stored in the finger index of each random file and where that data is stored.
Figure 2:
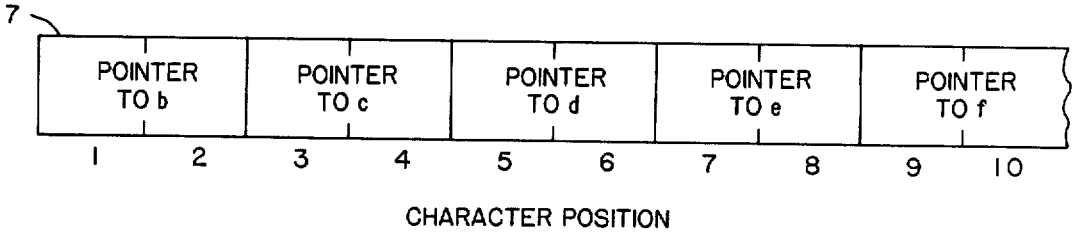

At this point the creation of the random file dictionary is complete. However, in order to speed execution of the process, a finger index must be created for each random file to indicate the starting point of certain letter combinations. Referring now to FIG. 2, this will be done by reserving the first two word positions in each random file for the pointer, or finger index, of the file. Therefore, when the sequential file is written to any random file it will start at record number 3.

Since two characters are necessary to store an integer number the four and five letter word files may contain no more than two pointers per word. Six and seven letter words may have three pointers and so on up to the longest word we could have.

The first pointer of the first word (6) will be used to mark the place at which the second character in the lower case word changes from "aa" to "ab", the next pointer will mark the change to "ac", then "ae" and so on. The first pointer of the second word (7) will mark the place at which the first character in the lower case word changes from "a" to "b", the next pointer for the change to "c", then "d" etc. for each letter in our dictionary.

The manner in which this information is obtained is by scanning each file after the file has been written to it and storing the record number at each break point. After scanning the file, each point is recorded at the place that has been reserved for it in either the first or second word of the file [FIG. 1(5)].

IMPLEMENTATION OF THE PROCESS

The following example outlines the operations that a computer must perform in order to execute the process for finding all words in any given word. The letters in the input word are first alphabetized then all permutations of those letters are listed for each successive word length to the minimum length required. Each of these permutations is then checked against the alphabetic listing in the special dictionary. If a match is found then all words associated with that permutation of letters is recorded. The process ends when all permutations listed have been checked in the dictionary. Any words that have been recorded as a match will constitute the solution.

To exemplefy this, the word BAKERY will be used. The special dictionary shows no anagrams for ABEKRY. Table 7 and 8 list the permutations of these letters and words found in the dictionary.

TABLE 7

| Five letter permutations of ABEKRY: | |
|---|---|
| ABEKR→BAKER | ABKRY→none |
| ABEKY→none | AERKY→none |
| ABERY→none | BEKRY→none |

TABLE 8:

| Four letter permutations of ABEKRY: | | |
|---|---|---|
| ABEK→BAKE, BEAK | BEKR→KERB | EKRY→none |

TABLE 8:-continued

| Four letter permutations of ABEKRY: | |
|---|---|
| ABER→BARE, BEAR, BRAE | BEKY→none |
| ABEY→none | BERY→none |
| ABKR→BARK | BKRY→none |
| ABKY→none | |
| ABRY→BRAY | |
| AEKR→RAKE | |
| AEKY→none | |
| AERY→AERY, YEAR | |
| AKRY→none | |

Implementation of this process on a small computer would follow the preceeding description except that, in order to speed up the process, the program would use the finger index that was created to search the dictionary from the starting point indicated to the last permutation of letters for that length word instead of searching it from the beginning of the file to the end.

Figure 3A:
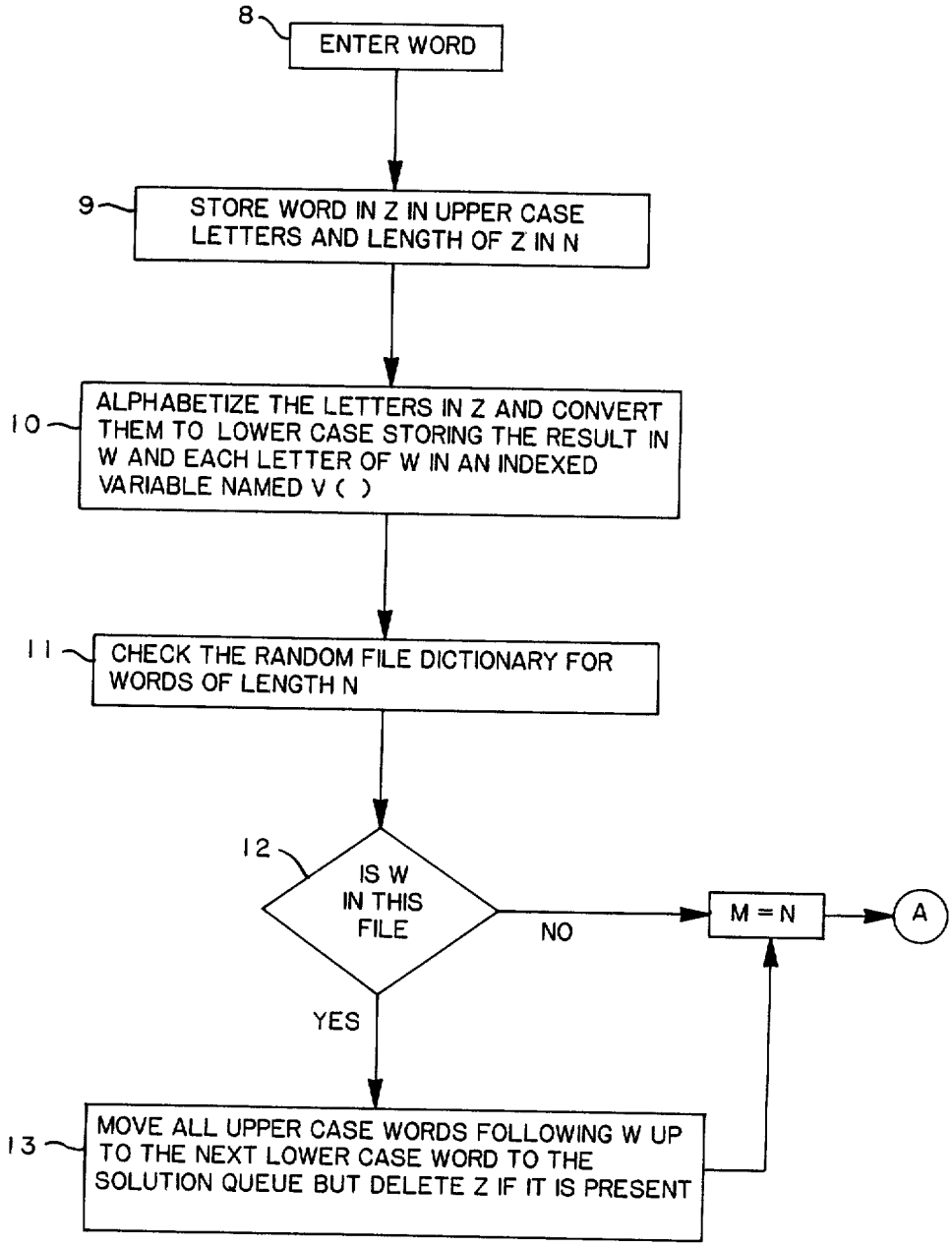

Referring now to FIGS. 3A and 3B, after a word has been input to the program for analysis (8) it will be stored in upper case letters (9). The program will then create a lower case variable W by converting and alphabetizing these letters and further store each individual letter in an indexed variable (10). A search is first made for the letters in alphabetical order to check for anagrams of the given word (11). If found (12) all but the given word is saved (13). The search for other words contained in the given word continues for words shorter than the given word at 14.

A file is opened and the finger index checked to find a point to start the search (15). Permutations are computed in a nested loop operation (16) for the subscript of the indexed variable which when concatenated will form the W variable (17). The file search loop (18) reads every other record excluding any upper case words found (19,20,21) to the next lower case word greater than or equal to W (22). Each time this loop is executed for any word length the search picks up from the point last referenced in the file so will continue no further than to the last permutation of letters generated for any file.

Matches to the W variable (24) would cause any upper case words following it in the file up to the next lower case word to be placed in the solution queue (25,26,27,28). Then permutations of the letters in the given word would be taken for successively shorter word lengths until the lower limit of word length is reached (30) after which the words in the solution queue may be alphabetized before being output in a readable format (31).

As an example of the nature of a program which may be used to achieve this result, assume that the dictionary has been created as described and illustrated by Table 6 for the four, five and six letter words and stored in files named $4, $5 and $6 respectively. The following program exemplefies the coding necessary to implement this process in the BASIC language for just one type of computer. Similar programs in other languages and for other computers may be readily derived by persons of reasonable skill.

```
100  DEFINT B-T: DEFSTR U-Z                                   'Defines integers & strings
105  DIM V(6),WORD(100)                                       'WORD is queue for solution
     V( ) holds alphabetized letters
110  DEF FNW(Y)=CHR$(ASC(Y)-32*(ASC(Y)<97))                   'Make lower case
120  Z="BAKERY"                                               'This is the input word
130  FOR J=1 TO 6: V(J)=FNW(MID$(Z,J)) : NEXT                 'Takes input and
     makes lower case letters then places them in V( )
140  FOR I=1 TO 6: FOR J=I=1 TO 6                             'Alphabetizes V( ) then
145  IF V(I)>V(J) THEN SWAP V(I), V(J)                         checks for anagrams
150  NEXT J: W=W+V(I): NEXT I: D=6: GOSUB 300                 'of input word
160  GOSUB 500: FOR N=1 TO NUMBER: IF Z=WORD(N) THEN WORD(N)=""")
170  NEXT: D=5: GOSUB 300                                     'Opens 5 letter word file
180  FOR i=1 TO 2: FOR J=I+1 TO 3'Sets up permutation of V( )
190  FOR K=J+1 TO 4: FOR L=K+1 TO 5: FOR M=L+1 TO 6
200  W-32 V(I)+V(J)+V(K)+V(L)+V(M): GOSUB 500 'Puts permutation in W
210  NEXT M,L,K.J,I
220  D=4: GOSUB 300                                           'Opens 4 letter word file
230  FOR I=1 TO 3: FOR J=I+1 TO 4                             'Sets up permutation of V( )
240  FOR K=J+1 TO 5: FOR L=K+1 TO 6
250  W=V(I)+V(J)+V(K)+V(L): GOSUB 500                         'Puts permutation in W
260  NEXT L,K,J,I: RESET
270  FOR N=1 TO NUMBER: PRINT WORD(N): NEXT                   'Prints words found
280  END
300  X=STR$(D): MID$(X,1)="                                   'Creates a file name
     ": RESET
310  OPEN "R",1,X,D: FIELD #1,D AS Y: MAX=LOF(1)/D            'aand opens it
320  REM
330  REM The following coding picks a starting point for the
     search using the FINGER INDEX.
340  REM
350  K=1: E=3: IF V(1)>"a"THEN GET 1,2: ON ASC(V)(1)) -97 GOTO 390,
     380: GOTO 370
360  GET 1,1: ON ASC(V(2)) -96 GOTO 560,390,380
370  K=5: GOTO 390
380  K=3
390  E=CVI(MID$(Y,K,2)): RETURN                               'E is the starting point
400  REM
410  REM
420  REM The following coding searches each file for the
430  REM alphabetic permutation of letters stored in W. The word
440  REM read from disk is stored in Y. If Y= W then all upper
450  REM case words following Y are stored in a subscripted
460  REM variaable named WORD. The number of the last word stored
470  REM here may be found in a variable called NUMBER.
```

-continued

```
480  REM
500  FOR E=E TO MAX STEP 2: GET 1,E                                  'Read every other word
510  IF ASC(Y)<91 THEN E=E+1: GET 1,E: GOTO 510                      'Skip upper case
520  IF Y=W GOTO 540                                                 'If word is less than permutation
     sought continue search.
530  NEXT: RETURN
540  IF W<>Y THEN RETURN                                             'Check if word is permutation sought
550  E=E+1: GET 1,E: IF 91 >ASC(Y) THEN NUMBER=NUMBER +1:
     WORD (NUMBER)=Y: GOTO 550                                       'if so store all upper case words
     following it
560  RETURN
```

UPDATING THE DICTIONARY

From time to time the need may arise to update the special dictionary made up to work with this process by either adding or deleting words. If the dictionary were a hard copy on paper it would be simple to either pencil in a new word or scratch out a word that is not necessary. However, an electronic media can be changed only by a programmed set of instructions.

Figure 4A:
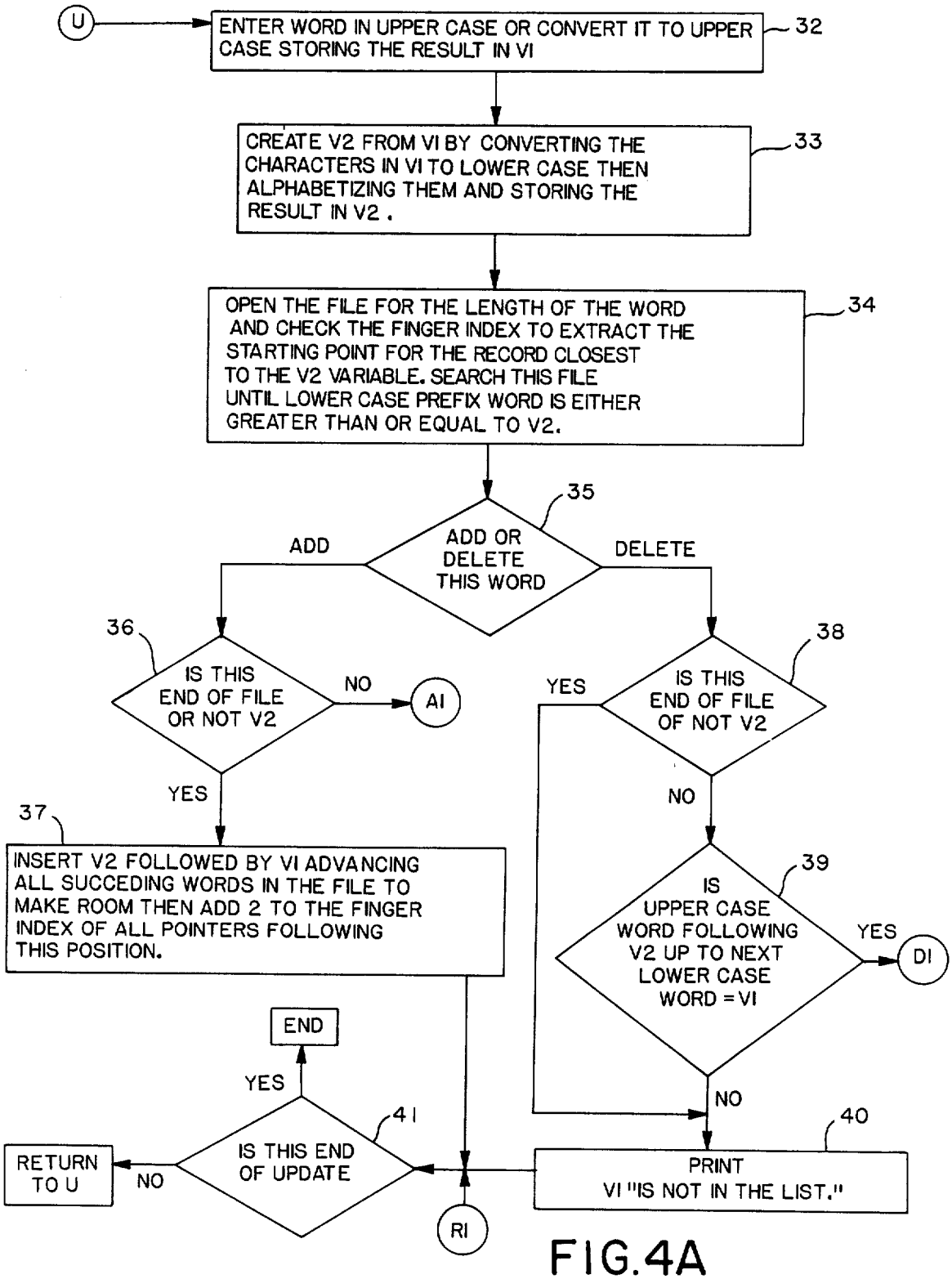
FIGS. 4A, 4B and 4C: are a flow chart of procedure used to update the special dictionary used in conjunction with this process by adding or deleting words in the random files and accordingly to update the finger index.
Figure 4B:
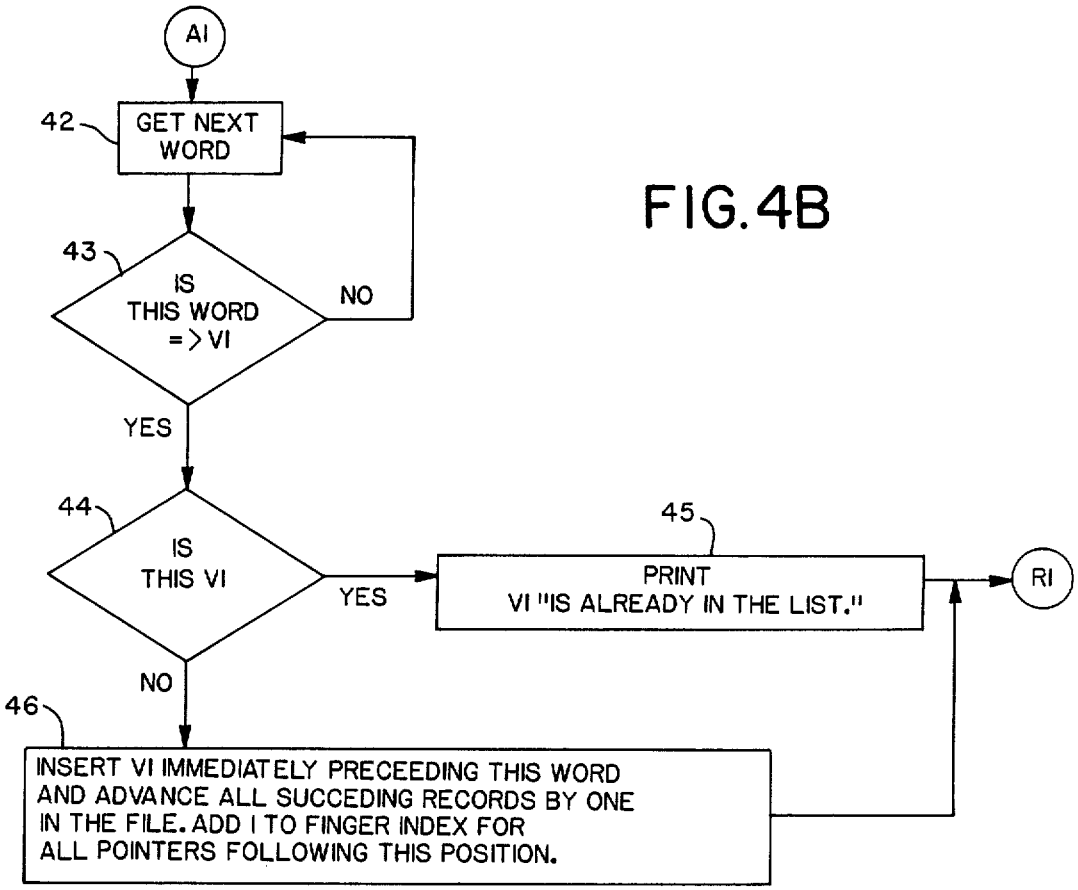
Figure 4C:
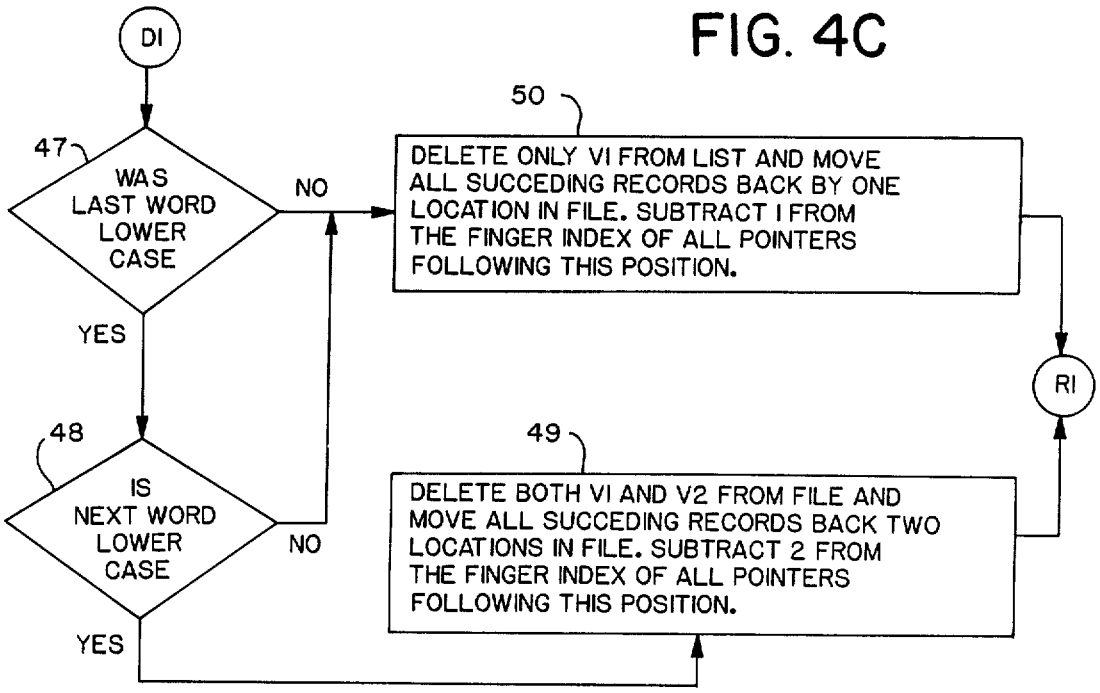
Figure 5:
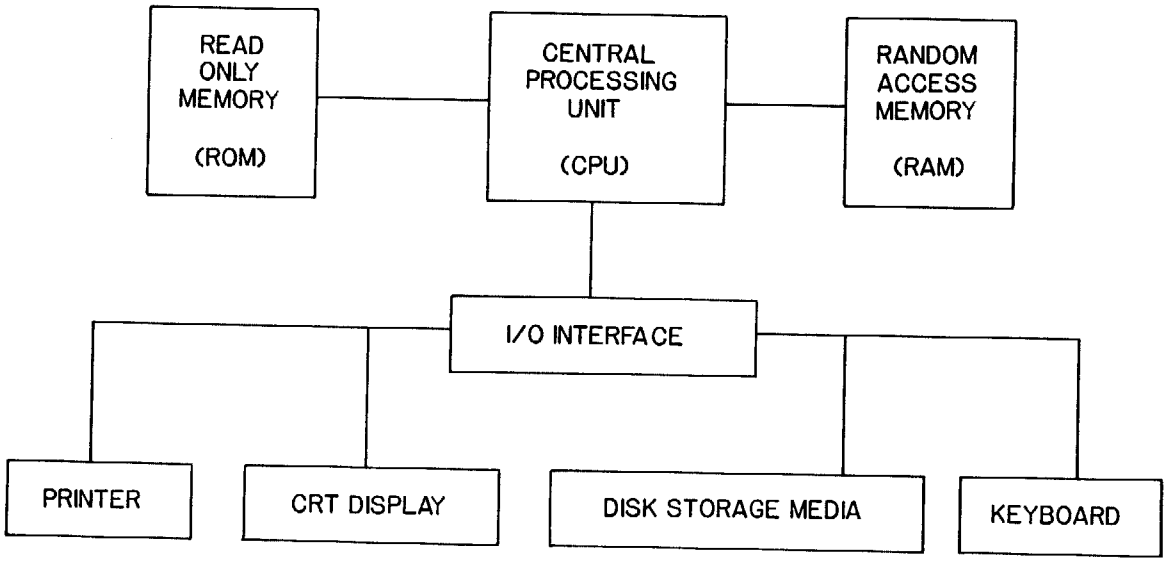
FIG. 5; is a block diagram of a programmable digital computer system utilized for implementing the procedure of this invention.

Referring to FIGS. 4A, 4B and 4C, when either adding or deleting words to this dictionary the word must first be input to the computer (32) either from the keyboard or by another input device. If the word is not entered in upper case the program will convert it to upper case and store it in a variable called V1. It will then create a second variable from the letters by alphabetizing and converting them to lower case then storing the result in a variable called V2 (33). Next, the file for words the same length as V1 will be opened and the finger index checked to extract the starting point of the record closest to the V2 variable. This file will be searched until a lower case word either greater than or equal to V2 is found (34). The procedure for either adding or deleting words differs from this point on so each will be discussed separately (35).

ADDING WORDS TO THE DICTIONARY

If the end of the file has been reached or if a lower case word is found that is greater than V2 (36) then V2 would be inserted in the list at that position followed by V1 and the finger index would be incremented by two for all letter combinations following the location of this word (37).

If a lower case word is found that is equal to V2 then all upper case words following V2 are compared to V1 (42,43). If an upper case word is found equal to V1 then a message would be printed saying V1 "is already in the list" (45) and the program would return to the start of this process for input of another word or to end the routine (41).

If an upper case word if found that is greater than V1 or if another lower case word is found then (44) only V1 would be inserted in the list immediately preceeding it. The finger index would be incremented by one for all letter combinations following the location of this word and the program would return to the start of the process to either end or process another word (41).

A sample of the coding necessary to provide this function for a single word is shown below:

```
100  DEFINT B-S: DEFSTR T-Z                                          'Defines integers and strings
110  DIM V(5): V1="BAKER": V2=V1                                     'Input word is BAKER
120  FOR J=1 TO 5: W=CHR$(ASC(MID$(V1,J)) XOR 32)                    'Make lower case
130  MID$(V2,J)=W: V(J)=W: NEXT                                      'Store in V2 and V( )
140  FOR I=1 TO 4: FOR J=I+1 TO 5: IF V(I)>V(J) THEN SWAP V(I), V(J)
150  NEXT J,I                                                        'Alphabetize letters in V( )
160  OPEN "R",1,"$5",5: FIELD #1,5 AS Y: MAX=LOF(1)/5
170  K=1: E=3: IF V(1)>"a" THEN GET 1,2: IF V(1)="b" GOTO 190
     ELSE K=3: GOTO 190
180  GET 1,1: IF V(2)="a" GOTO 200
190  E=CVI(MID$(Y,K,2))                                              'Use FINGER INDEX to get starting point
200  FOR J=E TO MAX: GET 1,J: IF V2>Y THEN NEXT: J=J-1               'Searches
                                                                     file til alphabetized input word
                                                                     exceeds word read from disk
300  IF J=MAX OR V2<>Y THEN H=2: GOSUB 450: LSET Y=V2: PUT 1,J:
     J=J+1: GOTO 330                                                 'If input is not alphabetized word then
                                                                     insert both alphabetized letters and word
310  J=J+1: GET 1,J: IF V1>Y GOTO 310                                'Check words following match
320  IF V1=Y THEN PRINT V1 "is already in the list":END ELSE H=1:
     GOSUB 450                                                       'If a match is found the word is already in list
330  LSET Y=V1: PUT 1,J                                              'If not, then insert it in list
400  IF V(1)>"a" GOTO 430                                            'Adjust FINGER INDEX
410  GET 1,1: ON ASC(V(2))-92 GOSUB 460,470
420  PUT 1,1: GET 1,2: GOSUB 460: GOTO 440
430  GET 1,2: IF V(1) ="b" THEN GOSUB 470 ELSE END
440  PUT 1,2: END
450  FOR L=MAX TO J STEP -1: GET 1,L: PUT 1,L+H: NEXT: MAX=MAX+H:
     RETURN
460  MID$(Y,1)=MKI$(CVI(MID$(Y,1))+H)
470  MID$(Y,3)=MKI$(CVI(MID$(Y,3))+H)
480  RETURN
```

DELETING WORDS FROM THE DICTIONARY

If this is the end of the file or if a lower case is found that is greater than V2 (38) then a message would be printed saying V1 "is not in the list" (40) and the program would return to the start of the process for input of another word or the process would end (41).

If V2 is found then all upper case words following it would be compared to V1. If V1 is not found (39) then the message would be printed saying V1 "is not in the list" (40) and the program would return to the beginning for input of another word or the process would end if there were no more updates (41).

If V1 is found then the words immediately preceeding and following it would be checked (47,48). If both words are lower case then V1 and the word immediately preceeding it would be deleted and two would be subtracted from the finger index of all letter combinations following the location of this word (49). However, if either adjacent word is upper case then only V1 will be deleted and the finger index would be decremented by one for all letter combinations following the location of this word (50).

A sample of the coding necessary to implement this function for a single word follows:

```
100  DEFINT B-S: DEFSTR T-Z                                          'Defines integers and strings
110  DIM V(5): V1="BAKER": V2=V1                                     'Input word is BAKER
120  FOR J=1 TO 5: W=CHR$(ASC(MID$(V1,J)) XOR 32)                    'Make lower case
130  MID$(V2,J)=W: V(J)=W: NEXT                                      'Store in V and V( )
140  FOR I=1 TO 4: FOR J=I+1 TO 5: IF V(I)>V(J) THEN SWAP V(I), V(J)
150  NEXT J,I                                                        'Alphabetize letters in V( )
160  OPEN "R",1,"$5",5: FIELD #1,5 AS Y: MAX=LOF(1)/5
170  K=1: E=3: IF V(1)>"a" THEN GET 1,2: IF V(1)="b" GOTO 190
     ELSE K=3: GOTO 190
180  GET 1,1: IF V(2)="a" GOTO 200
190  E=CVI(MID$(Y,K,2))                                              'Use FINGER INDEX to get starting point
200  FOR J=E TO MAX: GET 1,J: IF V2>Y THEN NEXT: J=J-1               'Searches
                                                                     file til alphabetized input word
                                                                     exceeds word read from disk
300  IF J=MAX OR V2<>Y GOTO 450 ELSE H=-1                            'If input is not word
                                                                     sought (V2) or if end of list
                                                                     then word is not in list
310  J=J+1: GET 1,J: IF ASC(Y)>90 GOTO 340 ELSE IF V1>Y GOTO 310
                                                                     'Searches for input word V1
320  IF V1<>Y GOTO 450 ELSE GET 1,J+1: IF ASC(Y)>96 THEN GET 1,J-1:
     IF ASC(Y)>96 THEN J=J-1: H=-2                                   'If not found then say so
                                                                     otherwise check for single or
                                                                     double deletion
340  FOR I=J TO MAX: GET 1,I-H: PUT 1,I: NEXT: MAX=MAX+H             'Delete
400  IF V(1)>"a" GOTO 430
410  GET 1,1: ON ASC(V(2))-96 GOSUB 460,470
420  PUT 1,1: GET 1,2: GOSUB 460: GOTO 440
430  GET 1,2: IF V(1)="b" THEN GOSUB 470 ELSE END
440  PUT 1,2: END
450  PRINT V1 "is not in the list": END
460  MID$(Y,1)=MKI$(CVI(MID$(Y,1))+H)
470  MID$(Y,3)=MKI$(CVI(MID$(Y,3))+H)
480  RETURN
```

What is claimed is:

1. A computer implemented method for processing words from a standard dictionary into a special dictionary by using a programmable digital computer system comprising the following steps:

(a) inputting a word in upper case letters from the standard dictionary as a first of two string variables for use by the computer, creating a second such string variable from the first string variable by alphabetizing the letters in the first string variable and converting said letters to lower case, then appending the first string variable to the second string variable to provide a concatenated record and storing the result as one record in a different sequential disk file respectively created for each different length record, (b) repeating step a) for each different word of said standard dictionary.

(c) placing the concatenated records in each sequential file in alphabetic order on disk media of the computer after input of such dictionary words is complete, (d) creating a corresponding random file for each sequential file in which the length of a record is equal to the length of the word so input from the standard dictionary in the sequential file, then reserving the first two words in each such random file for a finger index, (e) reading each sequential file, then writing both the lower and upper case words read to the corresponding random file, but if a succeeding record has the same lower case prefix as the one just written, then writing only the upper case word following the record just written, and (f) scanning the lower case words in each random file and storing the record number at which certain preselected letter prefixes change in a predetermined location of said first two words of the random file as a pointer or finger index.

2. A method according to claim 1, wherein the special dictionary resides on disk media, and further comprising either adding words to or deleting words from the special dictionary and updating the finger index accordingly to preserve its integrity.

3. A computer implemented procedure for finding all words contained in any given word of the special dictionary created by the method according to claim 1 comprising the following steps:

(a) inputting to the computer system in upper case letters a word and creating an anagram of such word by alphabetizing the letters in such word and converting those letters to lower case, thus creating an alphabetized lower case word constituting such anagram, (b) computing permutations of the letters in the anagram for successively decreasing lengths down to a selected minimum length, each length forming a respective group of juxtaposed letters, (c) comparing the permutations of juxtaposed letters for each specific word length to the lower case words in the random file for a record size equal to said specific word length from a starting point located by the finger index for the respective random file to the last permutation of letters so computed for the respective group of juxtaposed letters in search of a match, (d) taking the upper case words following any such match to the lower case permutation found in step c) up to the next lower case word and moving them to a solution queue, and, when all permutations of the letters in the alphabetized word have been searched, then (e) outputting the words in the solution queue in some readable form after optionally alphabetizing same.

* * * * *